US009639036B2

(12) United States Patent
Makino

(10) Patent No.: US 9,639,036 B2
(45) Date of Patent: May 2, 2017

(54) IMAGE HEATING APPARATUS HAVING A RUBBING ROTATABLE MEMBER

(71) Applicant: CANON KABUSHIKI KAISHA, Tokyo (JP)

(72) Inventor: Yuichi Makino, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/694,248

(22) Filed: Apr. 23, 2015

(65) Prior Publication Data

US 2016/0216658 A1 Jul. 28, 2016

(30) Foreign Application Priority Data

Apr. 24, 2014 (JP) ..... 2014-090094

(51) Int. Cl.
*G03G 15/20* (2006.01)

(52) U.S. Cl.
CPC ..... *G03G 15/2025* (2013.01); *G03G 15/2075* (2013.01); *G03G 2215/0141* (2013.01); *G03G 2215/2009* (2013.01); *G03G 2215/2016* (2013.01); *G03G 2215/2032* (2013.01)

(58) Field of Classification Search
CPC ..... G03G 15/2025; G03G 15/2075; G03G 15/2053; G03G 21/0035; G03G 2215/2016; G03G 2221/0073; G03G 2221/0089
USPC ..... 399/327, 329, 347; 219/216
See application file for complete search history.

(56) References Cited

U.S. PATENT DOCUMENTS 7,460,821 B2 * 12/2008 Ai ..... G03G 15/2025 399/328
7,756,458 B2 * 7/2010 Viney ..... G03G 15/2014 399/327
8,050,606 B2 * 11/2011 Inada ..... G03G 15/2025 399/327
2008/0038027 A1 * 2/2008 Ito ..... G03G 15/2025 399/328
2009/0297233 A1 * 12/2009 Kameda ..... G03G 15/5029 399/322
2014/0212188 A1 * 7/2014 Watanabe ..... G03G 15/2028 399/323
2014/0363194 A1 * 12/2014 Iwasaki ..... G03G 15/0291 399/100

FOREIGN PATENT DOCUMENTS

JP 2004082659 A * 3/2004
JP 2007078741 A * 3/2007
JP 2008-040365 2/2008

* cited by examiner

*Primary Examiner* — Robert Beatty
(74) *Attorney, Agent, or Firm* — Fitzpatrick, Cella, Harper & Scinto

(57) ABSTRACT

An image heating apparatus includes a first rotatable member and a second rotatable member configured to form a nip therebetween for heating a toner image on a recording material, a rubbing rotatable member configured to rub a surface of the first rotatable member, and a cleaning brush configured to clean a surface of the rubbing rotatable member. An average interval Sm of pits and projections of the surface of the rubbing rotatable member is 10-20 μm, and the cleaning brush includes fibers each having a diameter of not less than 5 μm and not more than the average interval Sm.

18 Claims, 13 Drawing Sheets

IMAGE HEATING APPARATUS HAVING A RUBBING ROTATABLE MEMBER

FIELD OF THE INVENTION AND RELATED ART

The present invention relates to an image heating apparatus for heating a toner image on a recording medium.

Hitherto, it has been a common practice to provide an electrophotographic image forming apparatus with a fixing device (image heating device) for fixing a toner image formed on the recording medium. Such a fixing device is provided with a pair of rotational members which form a nip, and fixes a toner image on recording medium to the recording medium by heating the toner image, in the nip.

The above-described rotational members are scarred due to their contact with the edges of the recoding medium, causing thereby the image forming apparatus to output images which are nonuniform in gloss. Therefore, the fixing device disclosed in Japanese Laid-open Patent application 2008-40365 is structured so that the rotational members are rubbed (abraded) by an abrasion roller (rotational rubbing (abrading) member).

More concretely, the above described rotational members are rubbed (abraded) by an abrasion roller so that the peripheral surface of the rotational members become roughly uniform in surface texture in terms of the lengthwise direction of the rotational members. Further, the device disclosed in Japanese Laid-open Patent Application 2008-40365 is provided with a rubber roller for cleaning the abrasion roller.

However, in a case where a rubber roller such as the one disclosed in Japanese Laid-open Patent Application 2008-40365 is employed, the minute protrusions and recesses of the peripheral surface of the abrasion roller are filled with minute particles resulting from the rubbing (abrading) of the rotational members, because the peripheral surface of the rubber roller is smooth. Thus, it is difficult to keep an abrasion roller satisfactory in cleaning performance for a long period of time with the use of a rubber roller as a roller for cleaning an abrasion roller.

SUMMARY OF THE INVENTION

According to an aspect of the present invention, there is provided an image heating apparatus comprising a first rotatable member and a second rotatable member forming a nip therebetween for heating a toner image on a recording material; a rubbing rotatable member for rubbing a surface of said first rotatable member; and a cleaning brush for cleaning a surface of said rubbing rotatable member, said cleaning brush comprising fibers having diameters not more than an average intervals Sm of pits and projections of the surface of said rubbing rotatable member.

These and other objects, features, and advantages of the present invention will become more apparent upon consideration of the following description of the preferred embodiments of the present invention, taken in conjunction with the accompanying drawings.

DESCRIPTION OF THE EMBODIMENTS

Figure 1:
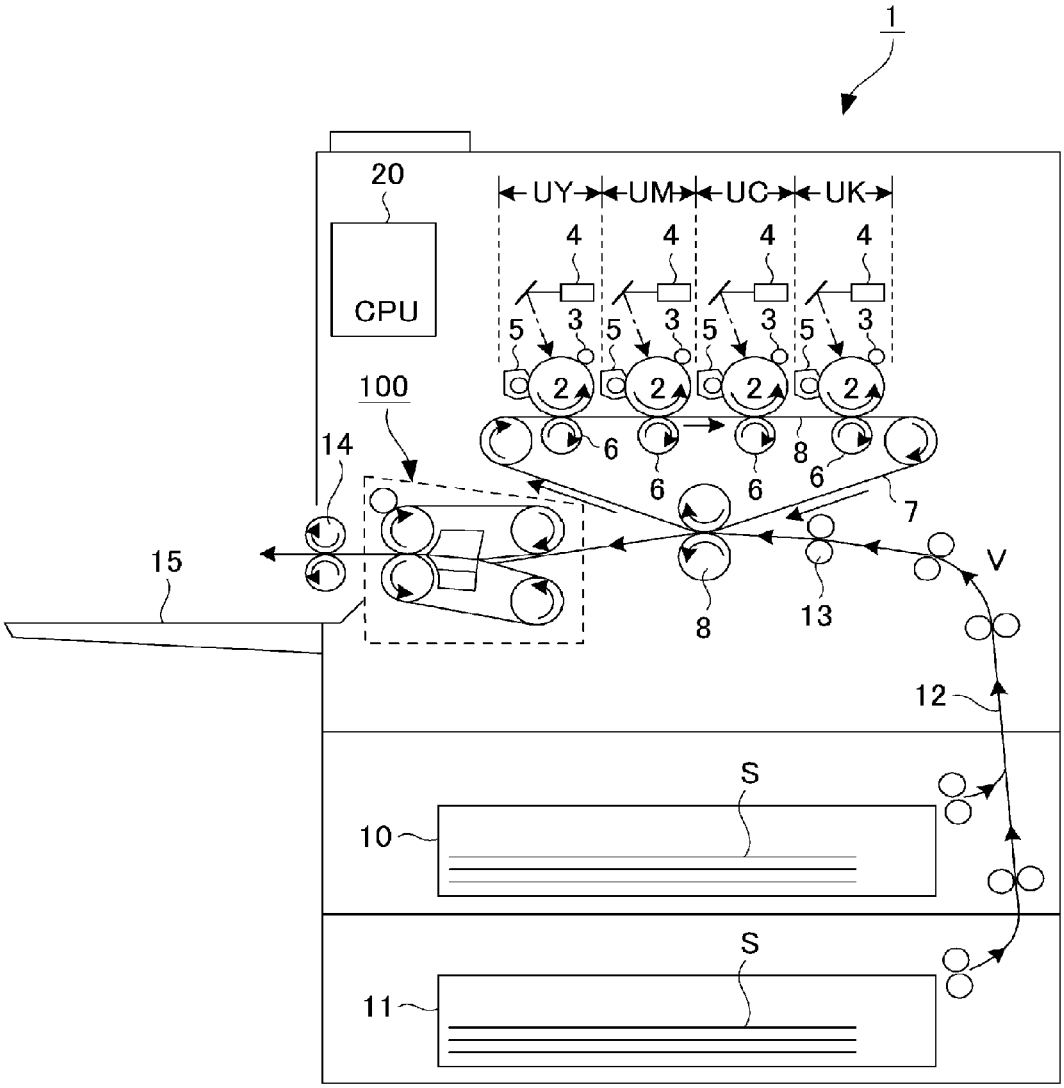
FIG. 1 is a schematic sectional view of a typical image forming apparatus, which is for describing the structure of the apparatus.

Referring to FIGS. 1-5, 6A, 6B, 7A, 7B, 8A, 8B, 9A, 9B, 10A, 10B, 11A, 11B, and 12, embodiments of the present invention are described. To begin with, referring to FIG. 1, the image forming apparatus in this embodiment is described about its general structure.

[Image Forming Apparatus]

The image forming apparatus in this embodiment is an electrophotographic full-color laser beam printer. The image forming apparatus 1 is provided with Y (yellow), M (magenta), C (cyan) and Bk (black) image formation sections UY, UM, UC and UK. Each image formation section U has: a photosensitive drum as an image bearing member; a charge roller 3 as a charging device; a laser scanner 4 as an exposing device; a developing device 5; etc. The photosensitive drum 2 is charged in advance by the charge roller 5. Then, the photosensitive drum 2 is exposed by the laser scanner 4, whereby a latent image is formed on the peripheral surface of the photosensitive drum 2. This latent image is developed by the developing device 5 into a toner image, the color of which depends upon the image formation section to which the developing device 5 belongs. Then, the four toner images, different in color, on the four photosensitive drums 2, one for one, are sequentially transferred onto an intermediary transfer belt 7, which is an intermediary transferring member, by the application of the primary transfer bias to a primary transfer roller. Consequently, a full-color toner image is effected on the intermediary transfer belt 7.

In cassettes 10 and 11 which are recording medium storing means, sheets S of recording medium (for example, sheets of recording paper, sheets of OHP film, etc.) are stored. The sheets S are fed one by one into the main assembly of the image forming apparatus 1 by the operation of a sheet feeding mechanism, while being separated from the rest. Then, each sheet S is conveyed to a pair of registration rollers 13 through a recording medium conveyance passage 12. The pair of registration rollers 13 catches the sheet S and temporarily holds the sheet S to correct the sheet S in attitude if the sheet S was being conveyed askew. Then, the pair of registration rollers 13 convey the sheet S to the area of contact between the secondary transfer belt 7 and secondary transfer roller 8 with such a timing that the sheet S arrives at the area of contact at the same time as the toner image on the intermediary transfer belt 7. The color toner image on the intermediary transfer belt is transferred onto the sheet S by the application of the secondary transfer bias to the secondary transfer roller 8. Thereafter, the sheet S is conveyed to the fixing device 100, in which the sheet S and the toner image thereon are subjected to heat and pressure. Thus, the toner image on the sheet S becomes fixed to the sheet S. Thereafter, the sheet S to which the toner image has just been fixed is conveyed further, and discharged into a delivery tray 15, which is a part of the top portion of the image forming apparatus, by a pair of discharge rollers 14. The CPU 20 as a controlling means controls motors, and the like, which drive various sections of the image forming apparatus 1 to make the apparatus form images.

[Fixing Device]

Figure 2:
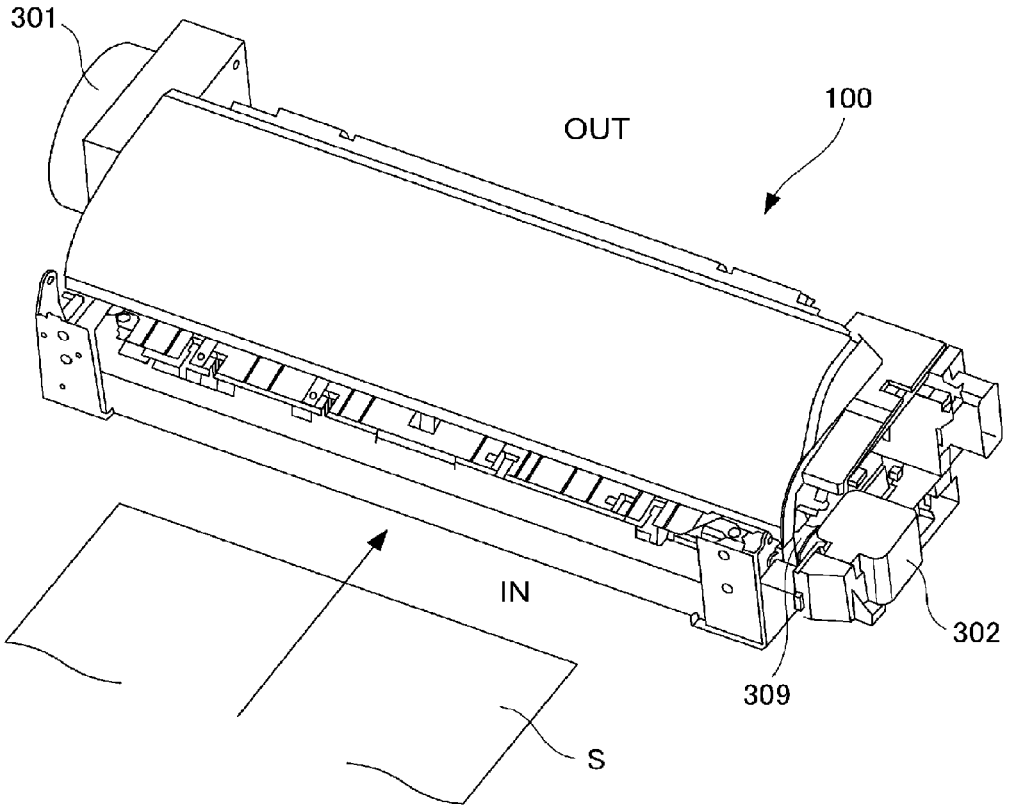
FIG. 2 is a perspective view of a typical fixing device.

Next, referring to FIGS. 2-5, 6A, 6B, 7A, 7B, 8A, 8B, 9A, 9B, 10A, 10B, 11A, 11B, and 12, the fixing device 100, which is an image heating device in this embodiment, is described about its structure. Referring to FIG. 2, the fixing device 100 is provided with a driving motor 301 and pressure application motor 302. As a sheet S of recording medium is inserted into the fixing device 100 from the entrance side of the device 100, the fixing device 100 drives these motors to convey the sheet S through the device 100 while keeping the sheet S pinched between its fixing members, and applying heat and pressure to the sheet S. Consequently, the toner image on the sheet S becomes fixed to the sheet S. Then, the fixing device 100 discharges the sheet S from its exit side.

Figure 3:
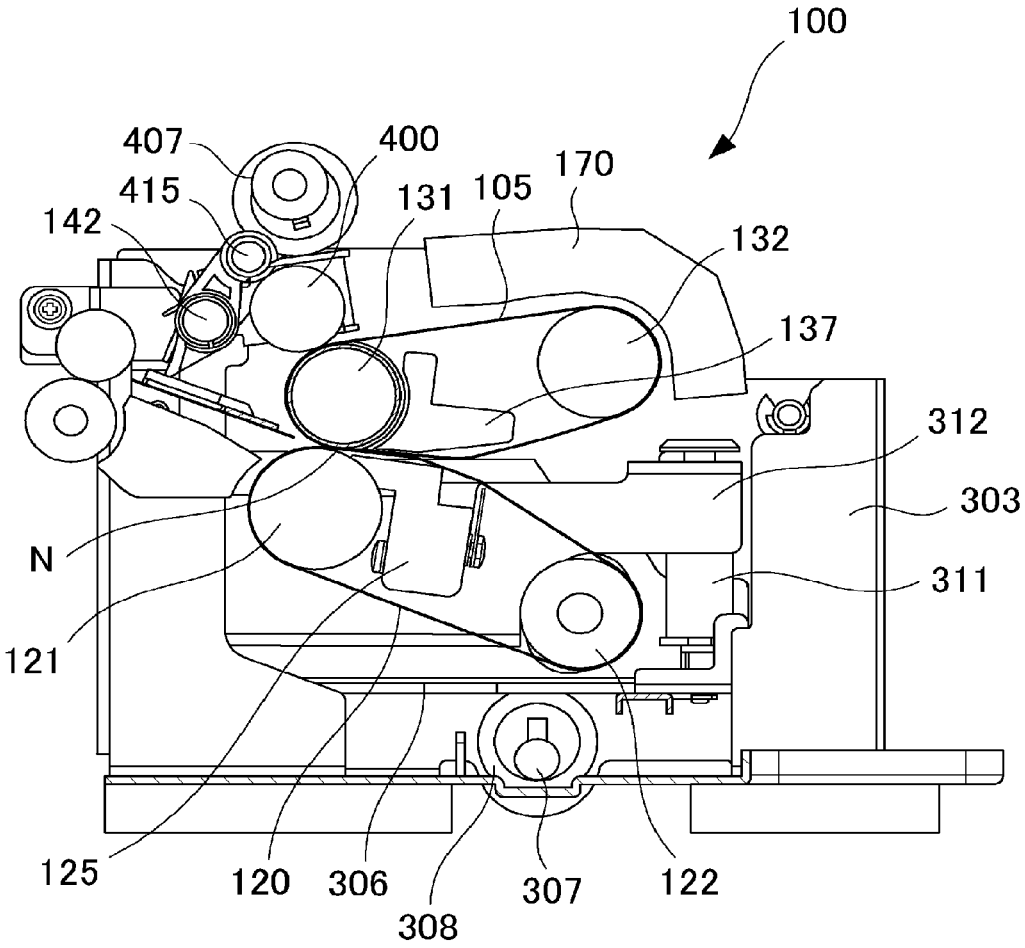
FIG. 3 is a sectional view of the fixing device when the fixation belt and pressure belt of which are in contact with each other.
Figure 4:
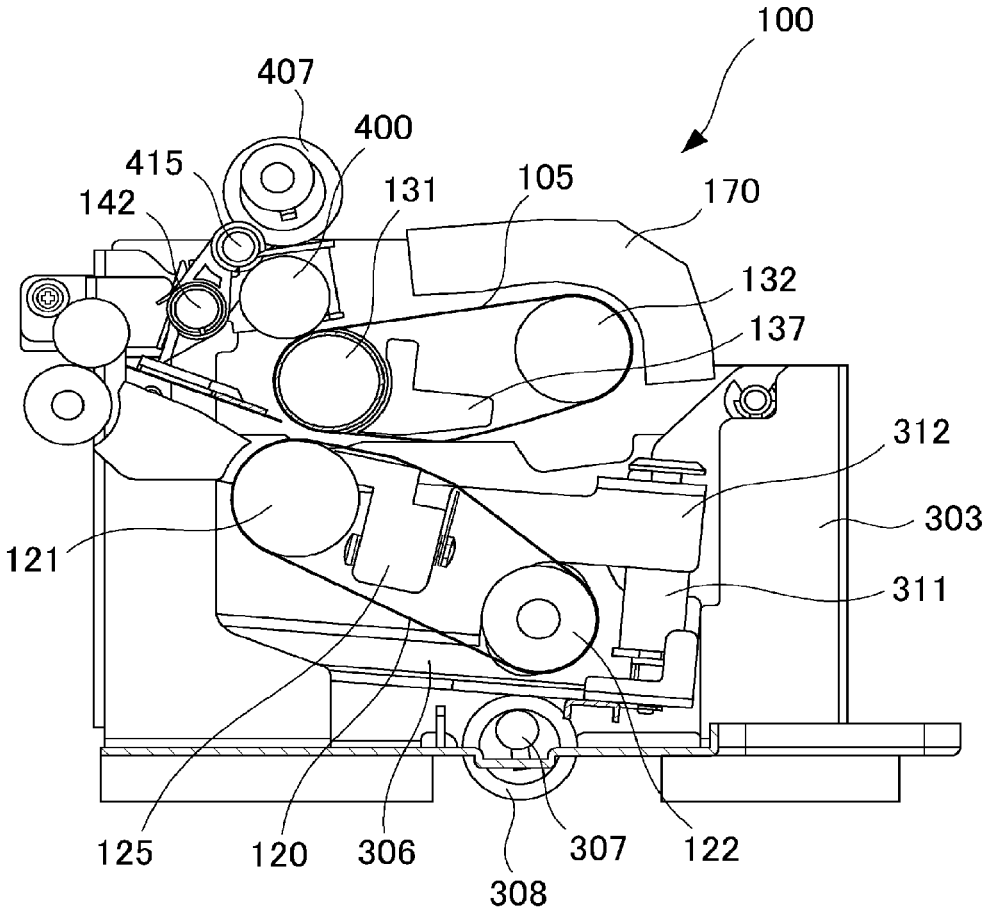
FIG. 4 is a sectional view of the fixing device when the fixation belt and pressure belt of which are separated from each other.

Referring to FIG. 3, the fixing device 100 is provided with a fixation belt 105 as the first rotational member, a pressure belt 120 as the second rotational member, an IH heater 170, an abrasion roller 400 as a rotational rubbing (abrading) member, a cleaning roller 415 as a cleaning member, etc. It heats the toner image formed on a sheet S of recording medium, in its fixation nip N, which is the area of contact between the fixation belt 105 and pressure belt 120. The IH heater 170 which is a magnetic flux generating means is made up of an excitation coil, a magnetic core, and a holder which holds the coil and core. It is disposed in the adjacencies of the upwardly facing portion of the surface layer of the fixation belt 105. As alternating electric current is flowed through the excitation coil, an alternating magnetic flux is generated. The alternating magnetic flux is guided by the magnetic core to the fixation belt 105. Thus, eddy current is generated in the fixation belt 105. This eddy current causes the fixation belt 105 to generate Joule's heat due to the presence of specific resistivity of the heat generating layer (which can be made to generate heat by induction). The alternating electrical current to be applied to the coil is controlled by the CPU 20 based on the temperature information from a thermistor for detecting the surface temperature of the fixation belt 105, in such a manner that the surface temperature of the fixation belt 105 remains at a preset level (roughly 150° C., for example).

The pressure belt 120 which is a nip forming member for forming the fixation nip N by being placed in contact with the fixation belt 105 is suspended by a pressure roller 121 and a tension roller 122. The tension roller 122 provides the pressure belt 120 with a preset amount (200 N, for example) of tension. The pressure belt 120 may be any type of belt as long as it is heat resistant. For example, it may be an endless belt formed by coating the peripheral surface of a metallic (nickel) substrate, which is 50 μm in thickness, 380 mm in width, and 200 mm in circumferential length, with silicon rubber to a thickness of 300 μm, and then, covering the silicon rubber layer with a piece of PFA tube as the surface layer. The pressure belt 120 such as the above-described one is placed in contact with the fixation belt 105, and is circularly moved by the movement of the fixation belt 105. It conveys a sheet S of recoding medium through the fixation nip N while keeping the sheet S pinched between itself and fixation belt 105.

The pressure roller 121 is a solid roller, and is made of stainless steel. It is 20 mm in external diameter. It is disposed on the sheet exit side of the fixation nip N which the combination of the pressure belt 120 and fixation belt 105 forms. There is disposed a pressure pad 125 formed on silicon rubber, for example, on the upstream side of the pressure roller 121, in terms of the recording medium conveyance direction. The pressure pad 125 is disposed so that it contacts the inward side of the pressure belt 120. The tension roller 122 is a hollow roller, and is formed of stainless steel. It is roughly 20 mm in external diameter, and 18 mm in internal diameter.

The fixation belt 105 is suspended by a driver roller 131 and a tension roller 132. The tension roller 132 provides the fixation belt 105 with a preset amount (200 N, for example) of tension. The fixation belt 105 may be any belt as long as it can be made to generate heat by the IH heater 170, and heat resistant. For example, it may be an endless belt formed by coating the peripheral surface of a metallic (nickel) substrate, which is 75 μm in thickness, 380 mm in width, and 200 mm in circumferential length, with silicon rubber to a thickness of 300 μm, and then, covering the silicon rubber layer with a piece of PFA tube as the surface layer.

The driver roller 131 is made up of a metallic core, and an elastic layer molded around the metallic core. More specifically, the metallic core is made of stainless steel, for example, and is 18 mm in diameter. The elastic layer is formed of heat resistant silicon rubber. In terms of the recording medium conveyance direction, the driver roller 131 is disposed on the sheet exit side of the fixation nip N formed by the combination of the fixation belt 105, and the pressure belt 120. As the pressure roller 121 is pressed against the driver roller 131, the elastic layer of the driver roller 131 is elastically deformed by a preset amount. On the upstream side of the driver roller 131 in terms of the recoding medium conveyance direction, a pad stay 137 formed of stainless steel (SUS), for example, is disposed on the inward side of the fixation belt 105.

Figure 5:
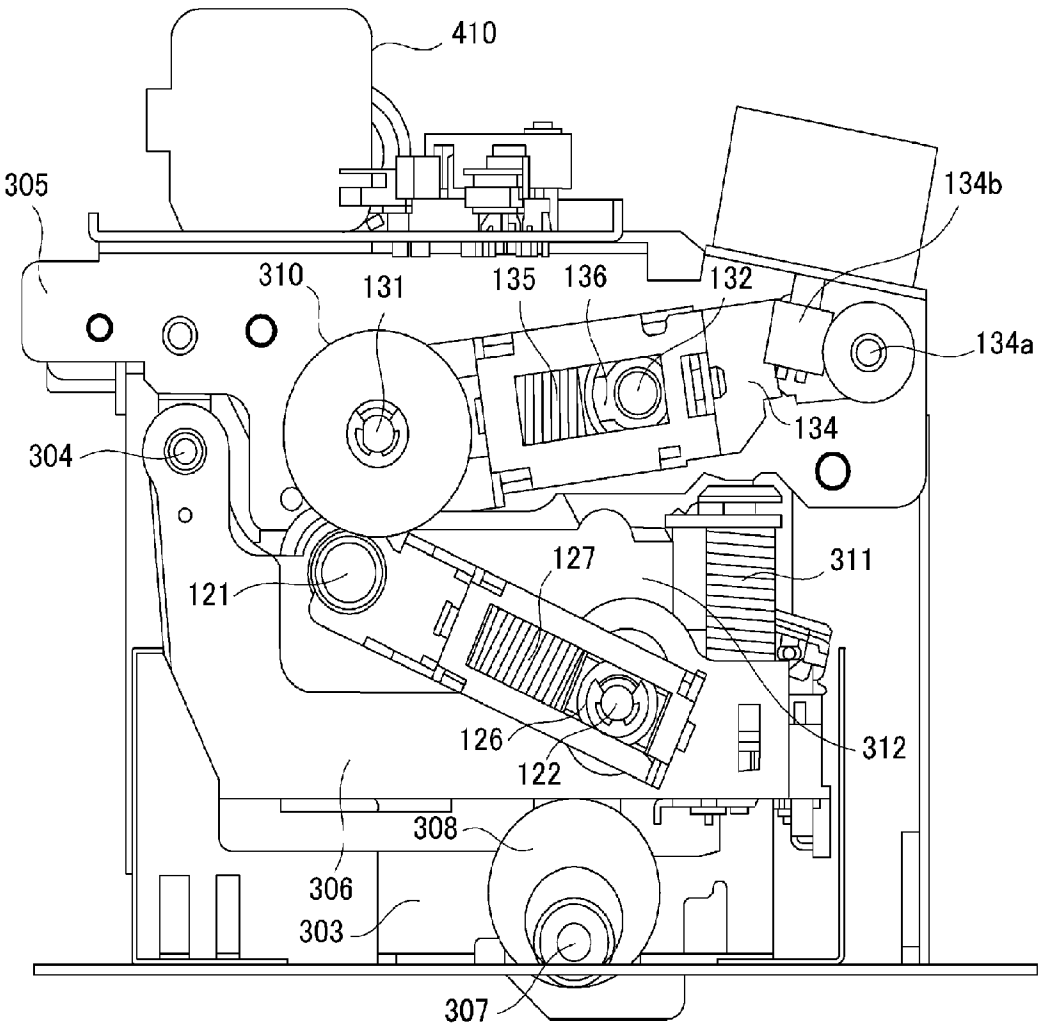
FIG. 5 is a side view of the fixing device, which does not show certain portions of the device.

The tension roller 132 is a hollow roller. It is formed of stainless steel, for example, and is roughly 20 mm in external diameter, and 18 mm in internal diameter. The tension roller 132 functions also as a steering roller which adjusts the snaking of the fixation belt 105 in the width wise direction of the fixation belt 105, which is perpendicular to the rotational direction of the fixation belt 105. Referring to FIG. 5, the lengthwise ends of the tension roller 132 are supported by a pair of bearings 125, one for one, which are under the pressure generated by a pair of tensioning springs 127, one for one. Further, one of the lengthwise ends of the tension roller 132 is supported by a pivotal arm 134, which is supported by a shaft 134*a* in such a manner that it can be pivotally moved about the shaft 134*a*. As the pivotal arm 134 is pivotally moved about the shaft 134*a*, the tension roller 132 is tilted. Thus, the fixation belt 105 suspended by the tension roller 132 is moved in its widthwise direction, being thereby adjusted in its positional deviation in its widthwise direction.

The driver roller 131 is rotationally driven by the driving motor 301. Referring to FIG. 2, the driving motor 301 is disposed outside the fixing device 100. Next, referring to FIG. 5, driving force is inputted into the driving force input gear 310 fixed to the rotational shafts of the driver roller 131. Thus, the driving motor 301 circularly moves the fixation belt 105 through the driver roller 131.

Referring to FIG. 5, the fixing device 100 is provided with a base frame 303, a top frame 305, and a bottom frame 306. The top frame 305 rotatably supports the driver roller 131, and holds the pad stay 137 by one of the lengthwise ends of the pad stay 137. It is fixed to the base frame 303. The bottom frame 306 rotatably supports the pressure roller 121, and also, supports the pressure pad 125 by the other end of the pad 125. It is supported by a hinge shaft 304, with which the base frame 303 is provided, in such a manner that it can be pivotally moved about the hinge shaft 304.

To the base frame 303, a pressure application cam shaft 307 is attached. To the lengthwise ends of the pressure application cam shaft 307, a pair of pressure application cams 308 are attached, one for one. Further, to the pressure application cam shaft 307, a pressure application gear is fixed. As the pressure application cam 308 is rotationally driven by the pressure motor 302 by a preset amount, the bottom frame 306 is pivotally moved into its pressure application position, shown in FIG. 3, or the noncontact position, shown in FIG. 4. That is, by rotating the pressure application cam 308, it is possible to move the pressure roller 121, etc., supported by the bottom frame 306, toward the fixation belt 105 to place the pressure belt 120 in contact with the fixation belt 105 (pressure application position). Also by rotating the pressure application cam 308, it is possible to move the pressure roller 121, etc., supported by the bottom frame 306, away from the fixation belt 105 to separate the pressure belt 120 from the fixation belt 105 (noncontact position).

Further, the pressure roller 121 is supported by the pressure application frame 312. Between the pressure application frame 312 and bottom frame 306, a pressure application spring 311 for applying pressure to the pressure application frame 312 when the pressure application frame 312 is in its pressure application position, is disposed. As the bottom frame 306 is moved into the pressure application position, the pressure application spring 311 applies a preset amount (400 N, for example) of pressure to the driver roller 131 and pad stay 137, which are on the inward side of the loop which the fixation belt 105 forms, with the use of the pressure roller 121 and pressure pad 125, respectively, which are on the inward side of the loop which the pressure belt 120 forms. Thus, the above-described fixation nip N is formed.

Figure 6B:
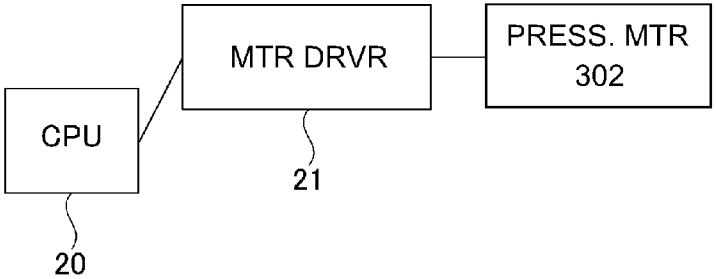
FIG. 6B is a block diagram of the means for placing the fixation belt and pressure belt in contact with each other, or separating them from each other.
Figure 6A:
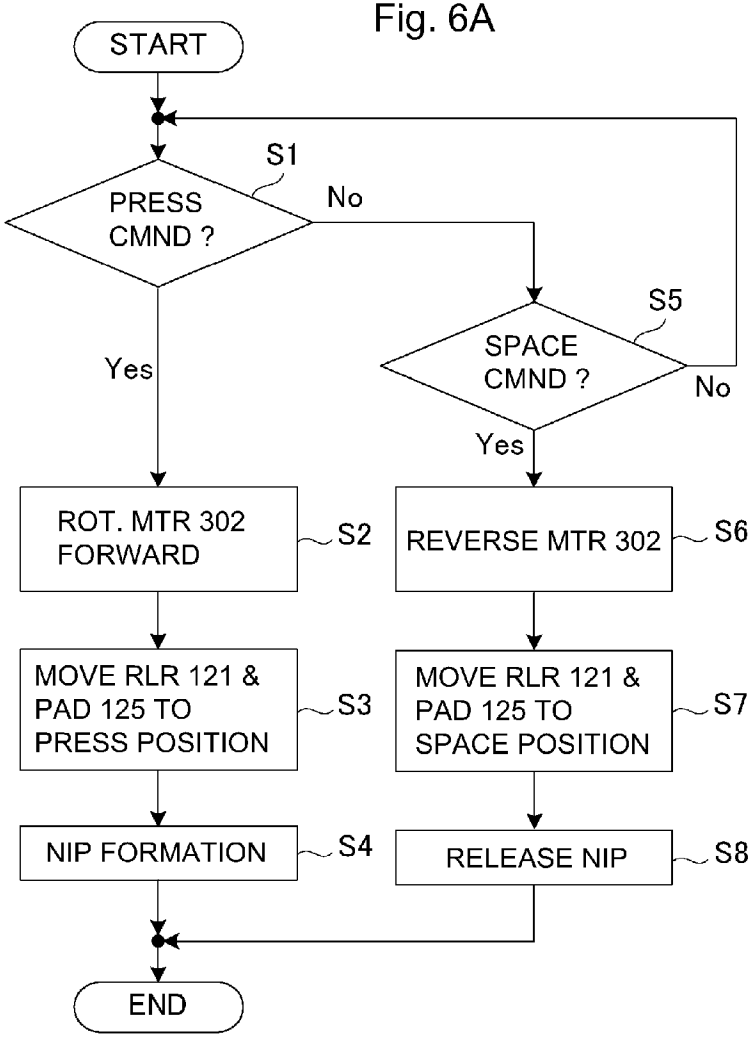
FIG. 6A is a flowchart of the operation for placing the fixation belt and pressure belt in contact with each other, or separating them from each other.

Next, referring to FIGS. 6A and 6B, the operation for forming the above described fixation nip N, and the operation for separating the pressure belt 120 from the fixation belt 105, are described. As a pressure application command is issued by the CPU 20 (S1), the pressure application motor 302 is rotated in the positive direction by the motor driver 21 (S2). Thus, the pressure application cam 308 is rotated by a preset amount, whereby the bottom frame 306 is moved upward. Thus, the pressure pad 125 and pressure roller 121 supported by the pressure application frame 3 are moved to the pressure application position (S3). Thus, the pressure belt 120 is pressed upon the fixation belt 105, forming thereby the fixation nip N (S4). Similarly, as a separation command is issued by the CPU 20 (S5), the pressure application motor 302 is rotated in the opposite direction (S6). Thus, the pressure application cam 308 is rotated by a preset amount, allowing the bottom frame 306 to move downward. Thus, the pressure pad 125 and pressure roller 121 supported by the pressure application frame 312 move into their noncontact position (S7). Thus, the pressure belt 120 separates from the fixation belt 105, causing thereby the fixation nip N to vanish (S8).

[Abrading (Roughening) Mechanism]

Next, referring to FIGS. 7A, 7B, 8A, 8B, 9A, 9B, 10A, 10B, 11A, and 11B, an abrading (roughing) mechanism which is for carrying out the process (rubbing (abrading or roughening) process) for restoring the fixation belt 105 in surface properties is described. An abrasion (roughening) roller 400 as a rotational rubbing (abrading) member which makes up the abrading mechanism is disposed next to the fixation belt 105, in such a manner that it can be placed in contact with, or separated from, the fixation belt 105. The abrasion roller 400 has minute protrusions (particles) and recesses across its peripheral surface. It rubs (abrades) the surface of the fixation belt 105 so that the fixation belt 105 becomes roughly uniform in surface texture in terms of its lengthwise direction.

Thus, the abrasion roller 400 is made up of a metallic (stainless steel) core which is 12 mm in diameter, and a particulate abrasive densely adhered to the peripheral surface of the metallic core with the use of an adhesive layer. Regarding the choice of the particulate abrasive, it is desired that those which are in a range of #1,000-#4,000 in particle size are chosen according to the target level of glossiness for an image to be formed. Regarding the average particle diameter of the particulate abrasive, a particulate abrasive which is #1,000 in particle size is roughly 16 μm in average particle diameter, whereas a particulate abrasive which is #4,000 in particle size is roughly 3 μm in average particle diameter. The particulate abrasive used in this embodiment is an aluminum-based abrasive (which is referred to as "alundum" or "morundum" (registered commercial brand name)). Alumina-based particulate abrasive is most widely used for industrial purpose. It is extremely hard compared to the surface of the fixation belt 105, and is angular in particle shape, being therefore excellent in abrasiveness. In this embodiment, particulate abrasive which is #2,000 in particle size (7 μm in average particle diameter) is used. The surface roughness Ra of the abrasion roller 400 is 2.0-4.0 μm, and roughly 10-20 μm in average particle interval (Sm).

Figure 7A:
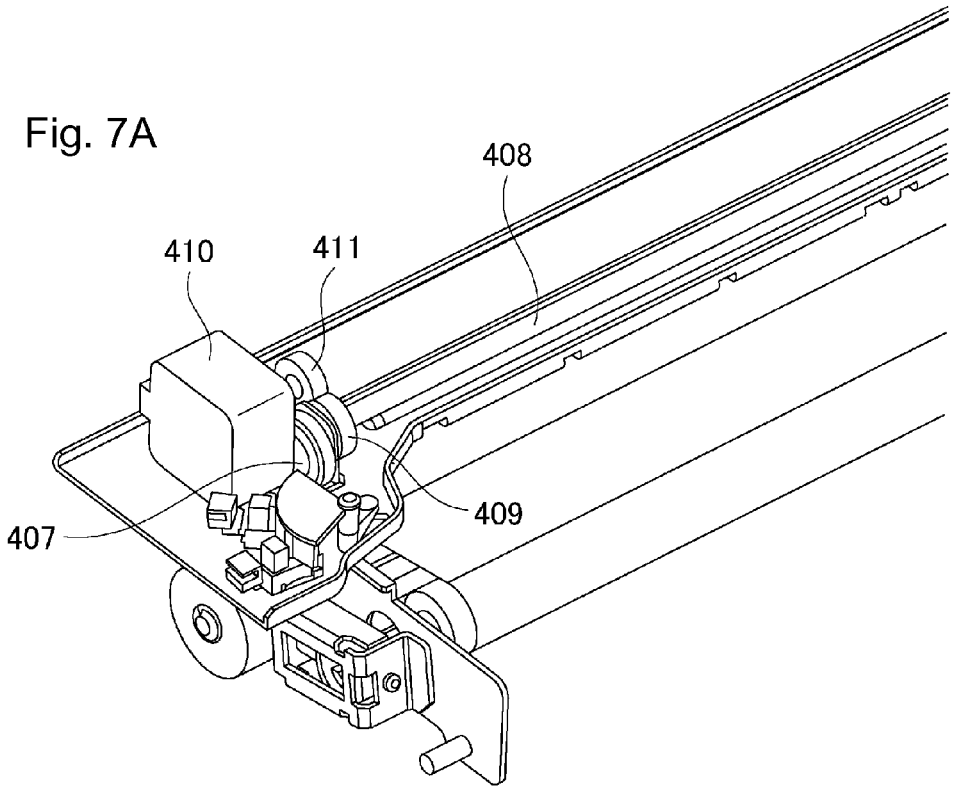
FIG. 7A is a perspective view of the mechanism for rotating the abrasion roller and also, placing the abrasion roller in contact with the fixation belt, or separating the abrasion roller from the fixation belt.
Figure 7B:
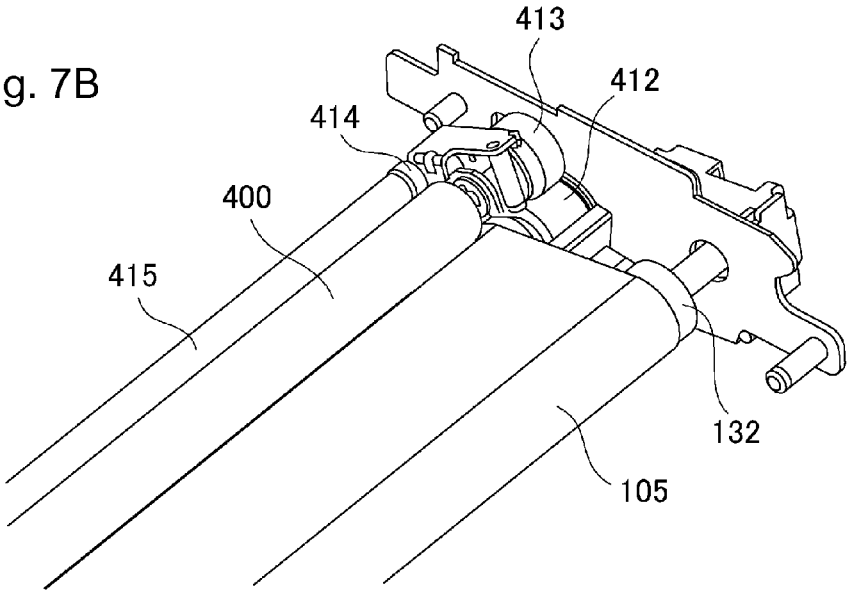
FIG. 7B is a perspective view of the same mechanism as the one in FIG. 7A, as seen from the opposite direction from the direction from which the mechanism is seen in FIG. 7A.

Next, the mechanism for placing the abrasion roller 400 in contact with, or separating the abrasion roller 400 from, and also, rotating the abrasion roller 400, is described. Referring to FIGS. 7A and 7B, to the lengthwise ends of the RF cam shaft 408 supported by the frame of the fixing device 100, a pair of RF cams 407 are fixed, one for one. To the RF cam shaft 408, an RF engagement-disengagement gear 409 is fixed. The CPU 20 controls the RF cams 407 in rotational phase by rotating the RF cam shaft 408 by the rotation of the RF pressure application motor 410, through the RF motor gear 411 and RF engagement-disengagement gear 409.

Figure 8A:
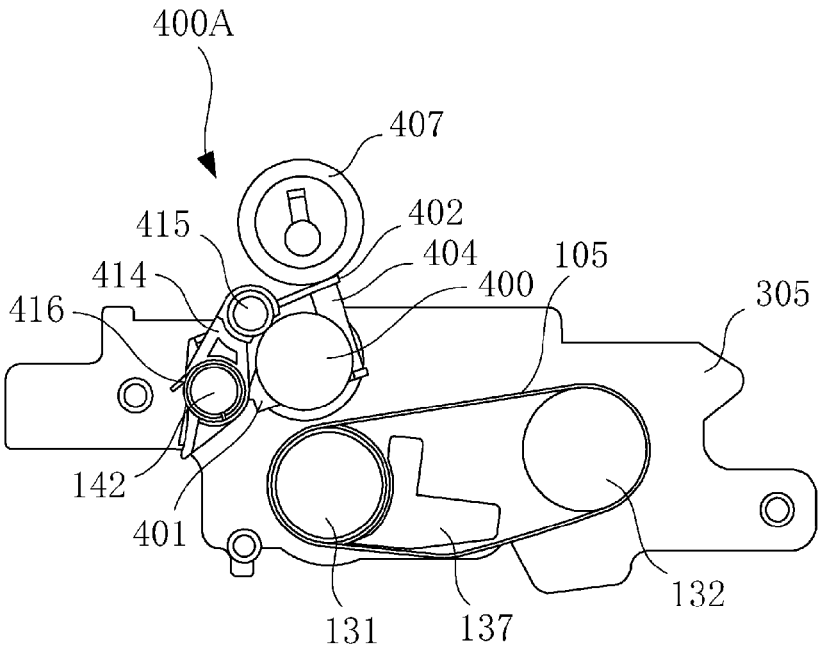
FIG. 8A is a sectional view of parts of the fixing device when the abrasion roller of the device is separated from the fixation belt.
Figure 8B:
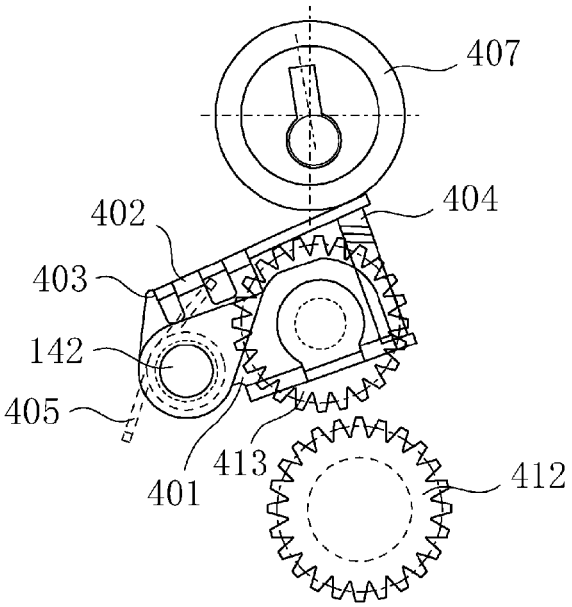
FIG. 8B is a sectional view of portions of the driving mechanism, which are directly related to the present invention.

Referring to FIGS. 8A and 8B, the abrasion roller 400 is rotatably supported by the support arm 401 rotatably supported by the shaft 142 fixed to the top frame 305, with the placement of a pair of bearings between the abrasion roller 400 and supporting arm 401. Further, the pressure application arm 402 is rotatably supported by the shaft 142. Between the support arm 401 and pressure application arm 402, a pressure application spring 404 is disposed. Next, referring to FIG. 8B, the pressure application arm 402 is provided with a separation spring 405. The opposite end of the separation spring from the pressure application arm 402 is held by the top frame 305. The separation spring 405 keeps the pressure application arm 402 pressured toward the RF cam 407, causing thereby the pressure application arm 402 to rotate. Thus, it is possible for the abrasion roller 400 to be moved upward or downward, following the rotation of the RF cam 407. That is, the abrasion roller 400 can be moved into the pressure application position, shown in FIGS. 9A and 9B, in which it forms the abrasion nip R, and the noncontact position shown in FIGS. 8A and 8B. In this embodiment, the RF cam 407, pressure application arm 402, pressure application spring 404, support arm 401, and separation spring 405 make up the mechanism 400A for placing the abrasion roller 400 in contact with, or separating the abrasion roller 400 from, the fixation belt 105.

Further, to the shaft of the abrasion roller 400, a gear 413 is coaxially attached. To the shaft of the driver roller 131, which is one of the rollers by which the fixation belt 105 is suspended, a driving gear 412 is coaxially attached. Next, referring to FIGS. 9A and 9B, as the abrasion roller 400 is moved into its pressure application position by the rotation of the RF cam 407, the driving gear 412 and gear 413 mesh with each other, whereby the driving force from the driver roller 131 driven by the driving motor 301 is transmitted to the abrasion roller 400 through the driving gear 412 and gear 413. On the other hand, as the abrasion roller 400 is moved into the noncontact position by the rotation of the RF cam 407, the driving gear 412 and gear 413 disengage from each other, as shown in FIGS. 8A and 8B. Thus, the driving force is not transmitted from the driving roller 131 to the abrasion roller 400. Therefore, the abrasion roller 400 stops rotating.

Next, the above-mentioned pressure application position and noncontact position of the abrasion roller 400 are more concretely described. To begin with, referring to FIGS. 8A and 8B, the noncontact position of the abrasion roller 400 is described. As the RF cam 407 is rotated into a preset position in terms of rotational phase following the sequence which will be described later, the support arm 401 and pressure application arm 402 are moved in the directions to separate from each other by the force of the pressure application spring 404. Then, the pressure application arm 402 comes into contact with the stopper portion of the support arm 401, being held in position by the stopper portion, and is moved upward, in FIGS. 8A and 8B, by the force generated by the separation spring 405. During this movement of the pressure application arm 402, the driving gear 412 and gear 413 are not in mesh with each other. Thus, even when the fixation belt 105 is driven while an image is formed by the image forming apparatus 1, no driving force is transmitted to the abrasion roller 400.

Figure 9A:
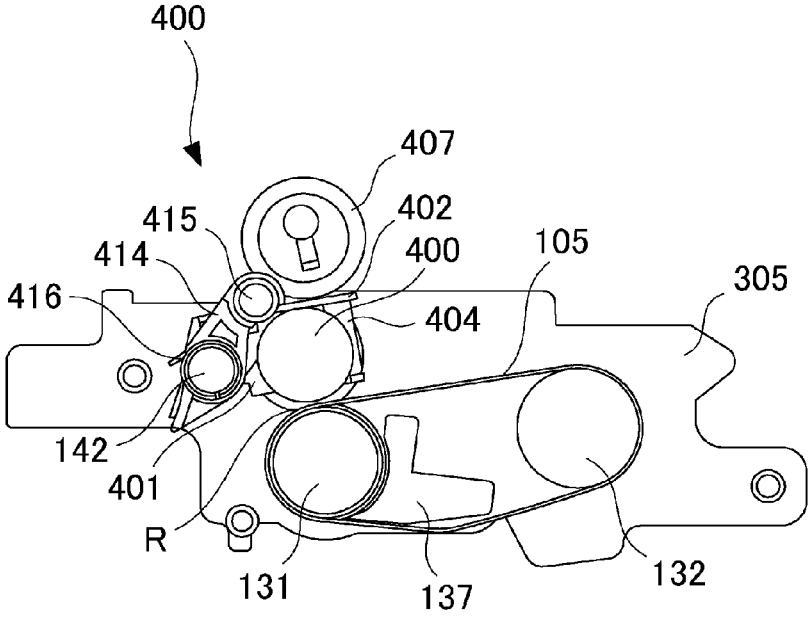
FIG. 9A is a sectional view of parts of the fixing device when the abrasion roller of the device is in contact with the fixation belt.
Figure 9B:
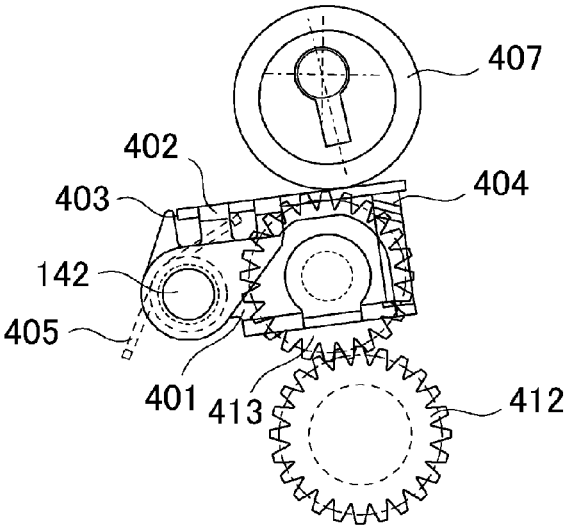
FIG. 9B is a sectional view of portions of the driving mechanism, which are directly related to the present invention.

Next, referring to FIGS. 9A and 9B, the pressure application position of the abrasion roller 400, in which the abrasion roller 400 performs its abrading operation, is described. As the RF cam 407 begins to be rotated toward the pressure application position by the sequence which will be described later, the pressure application arm 402 moves downward, in FIGS. 9A and 9B. Thus, the support arm 401 and abrasion roller 400 are moved toward the fixation belt 105 by the pressure application spring 404, and the abrasion roller 400 comes into contact with the fixation belt 105. As the RF cam 407 is rotated further, the pressure application arm 402 is moved toward the support arm 401. Thus, the abrasion roller 400 is pressed upon the fixation belt 105 by the preset amount of pressure generated by the pressure application spring 404, forming thereby the abrasion nip R. In this embodiment, the fixing device 100 is structured so that when the abrasion nip R is formed, the amount of contact pressure generated between the abrasion roller 400 and fixation belt 105 becomes 15 kgf (nearly equal to 150 N).

By the above-described operation for placing the abrasion roller 400 in contact with the fixation belt 105, not only is the abrasion roller 400 placed in contact with the fixation belt 105, but also, the driving gear 412 coaxially attached to the driving roller 131 is made to mesh with the gear 413 coaxially attached to the shaft of the abrasion roller 400. Thus, the abrasion roller 400, the surface layer of which is an abrasive layer, is rotated in the "with direction" (such direction that surface of abrasion roller 400 moves in the same direction as surface of fixation belt 105), with the presence of a preset amount of difference in peripheral velocity between the abrasion roller 400 and fixation belt 105. Thus, the surface of the fixation belt 105 is uniformly abraded to a preset level of roughness.

If the above-mentioned difference in peripheral velocity is small, the resultant roughness of the surface of the fixation belt 105 will be less than the desired level of roughness. In this embodiment, therefore, the reduction ratio between the driving gear 412 and gear 413 was set to 1.3:1. More concretely, it was set so that when the revolution of the driving motor 301 is 3,000 rpm, the difference in peripheral velocity became 90 mm/sec. By abrading the fixation belt 105 with the use of the abrasion roller 400 under the above described condition, it is possible to restore the roughness of the surface layer of the fixation belt 105 to Rz 0.5-1.0. By fixing a toner image to a sheet of recording medium as described above, with the use of the fixation belt 105 adjusted in surface roughness to the above described level, it is possible to prevent the texture of the surface layer of the fixation belt 105 from being conspicuously imprinted across the toner image, and therefore, it is possible to output images which have a proper level of glossiness.

Figure 10B:
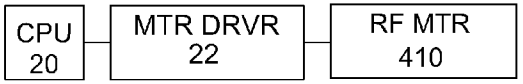
FIG. 10B is a block diagram of the abrading means.
Figure 10A:
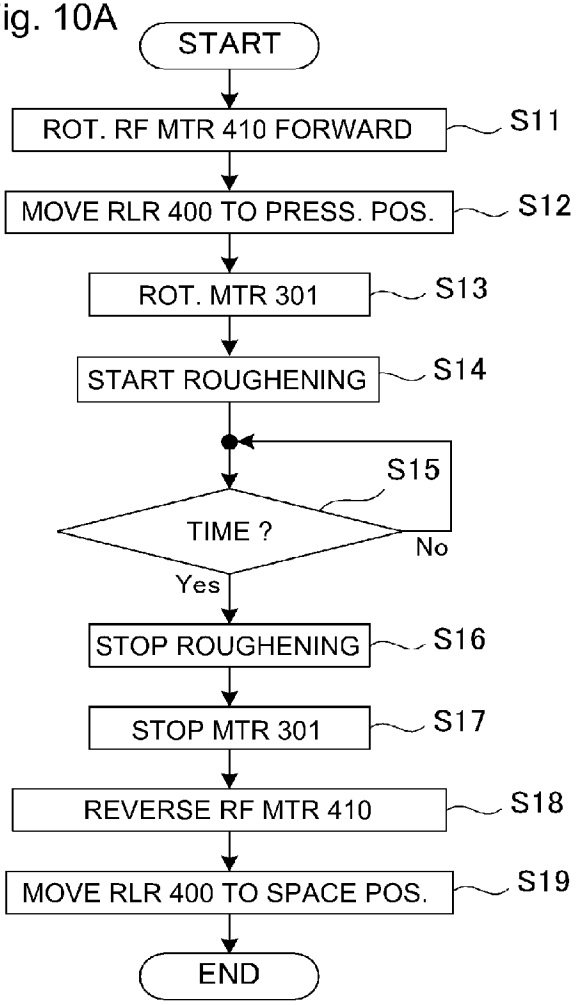
FIG. 10A is a flowchart of the abrading operation of the abrasion roller.

Next, referring to FIGS. 10A and 10B, the operational sequence carried out by the abrading mechanism when the abrasion roller 400 is in the above described noncontact position, or pressure application position, is described. In a case where the fixing device 100 is structured as described above, the above described operational sequence of the abrasion roller 400 can be carried out regardless of the presence or absence of the fixation nip N. However, if the abrading mechanism is made to operate while the fixation nip N is present, it is possible that meshing of gears will cause vibrations, and/or the load to which the driving motor 301 is subjected will increase. In this embodiment, therefore, the operation for abrading the fixation belt 105 is carried out when the fixation nip N is not present.

First, it is checked whether or not the fixation nip N is present. If it is determined that the fixation nip N is not present, a pressure application command is issued by the CPU 20. Thus, the RF pressure application motor 410 is rotated in the positive direction by a preset amount, by the motor driver 22 (S11). Thus, the RF cam 407 is rotated by a preset amount by the driving force transmitted thereto through the above described drive train, causing thereby the abrasion roller 400 supported by the support arm 401 to move into the pressure application position. Thus, the abrasion nip N is formed (S12). Then, the CPU 20 starts rotating the abrasion roller 400 (S13), and starts the abrading operation (S14). As a preset length of time elapses after the starting of the abrading operation (S15), the CPU 20 ends the abrading operation (S16), and stops the driving motor 301 (S17). Then, the CPU 20 reversely rotates the RF pressure application motor 410 by a preset amount (S18), and moves the abrasion roller 400 into the noncontact position (S19). Then, CPU 20 ends the abrading sequence.

Next, the abrading operation (surface property restoration operation) for restoring the fixation belt 105 in surface properties is described. The abrading operation is effective when it is carried out after the portions of the fixation belt 105, which came into contact with the edges of a sheet of recording medium, became rougher in surface texture than the rest of the fixation belt 105. The abrasion roller 400 is made to operate by the above-described mechanism, following the above described sequence. It rubs (abrades) the outward surface of the fixation belt 105 across approximately the entire range of the fixation belt 105 in terms of its lengthwise direction (widthwise direction which is intersectional to rotational direction of fixation belt 105). Thus, the portions of the surface of the fixation belt 105, which had become rougher in texture by their contact with the edges of a sheet of recording medium, becomes about the same in surface roughness as the portions of the surface of the fixation belt 105, which did not come into contact with the edges of a sheet of recording medium. Therefore, the deterioration of the surface of the fixation belt 105 becomes inconspicuous.

To describe more concretely, in this embodiment, the surface of the fixation belt 105, which was partially increased in roughness Rz to roughly 2.0, is restored in surface roughness Rz through the abrading operation carried out by the abrasion roller 400, so that the fixation belt 105 is restored in surface roughness Rz to 0.5-1.0. Assuming here that the amount of difference in surface roughness Ra between the portions of the fixation belt 105, which came into contact with the edges of a sheet of recording medium a substantial number times, and the portions of the fixation belt 105, which did not come into contact, is ΔRa, the surface of the fixation belt 105 is processed so that the value of ΔRa is reduced from roughly 0.3 to roughly 0.1 by the abrading operation (surface property restoration operation). As described above, in this embodiment, the role of the abrasion roller 400 is to keep the fixation belt 105 satisfactorily low in surface roughness for a long period of time. This is related to the prevention of the problem that the image forming apparatus 1 outputs images which are non-uniform in gloss and/or undesirably low in gloss.

[Cleaning Roller]

Figure 11A:
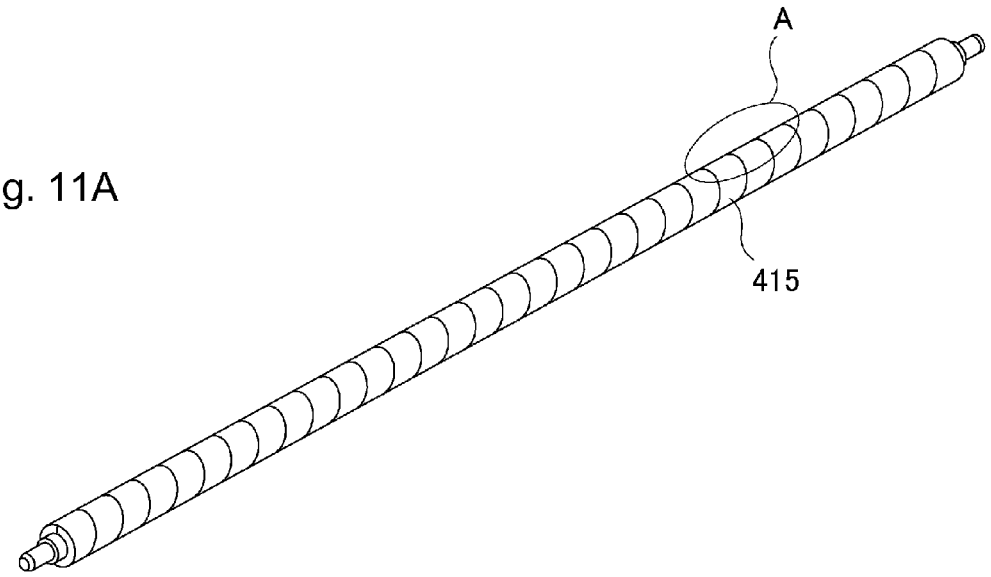
FIG. 11A is a schematic perspective view of the cleaning roller.
Figure 11B:
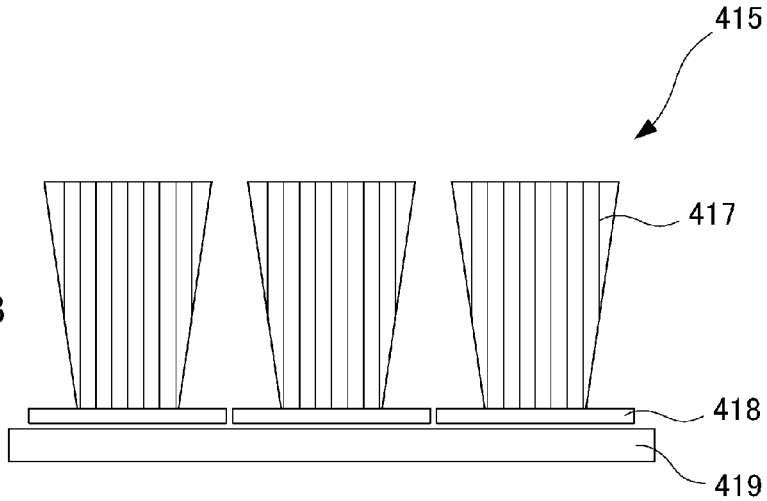
FIG. 11B is an enlarged schematic sectional view of a section A in FIG. 11A.
Figure 12:
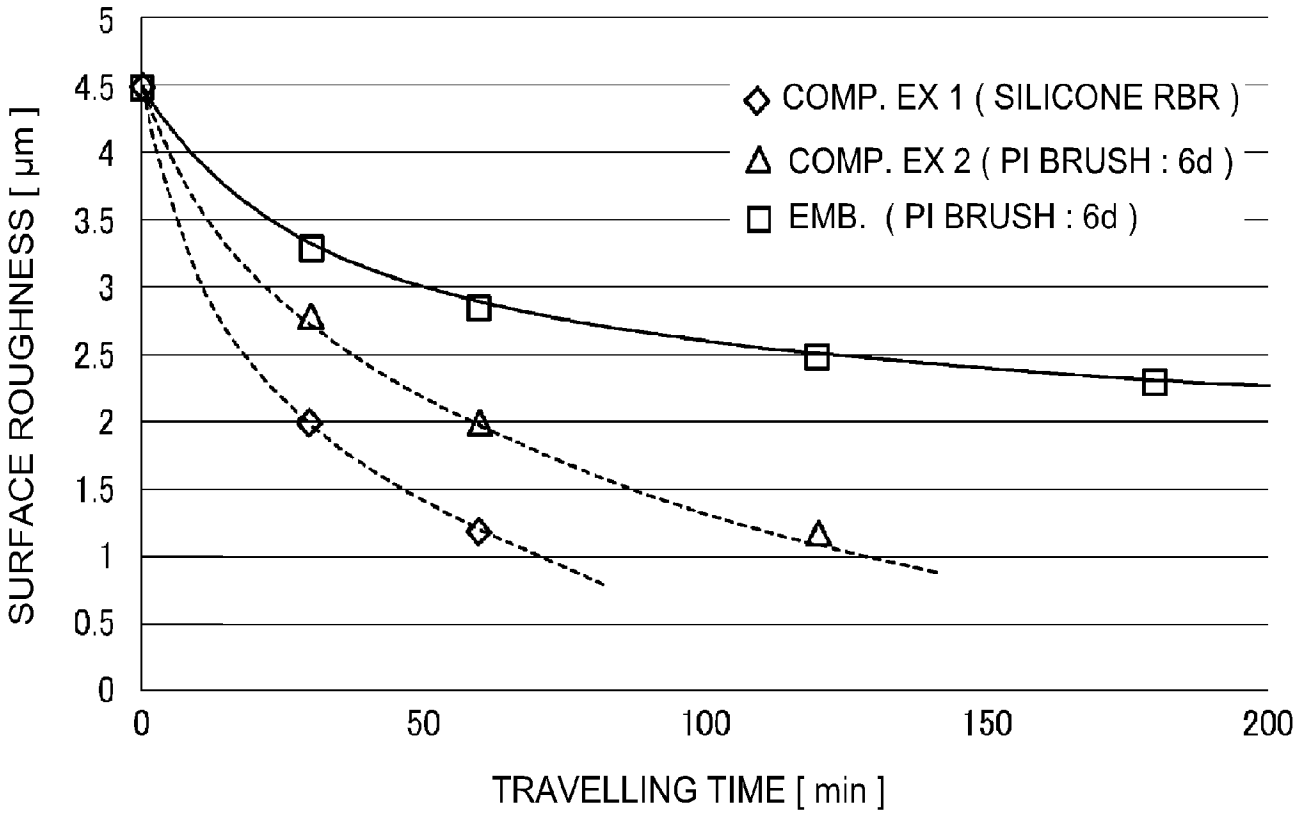
FIG. 12 is a drawing which shows the results of experiments.

Next, referring to FIGS. 11A, 11B and 12, along with FIGS. 8A and 8B, for example, the cleaning roller 415, which is a cleaning member for cleaning the surface of the abrasion roller 400, is described. As described above, as the abrasion roller 400 abrades the surface layer of the fixation belt 105, a minute amount of toner, paper dust, having become welded to the surface layer of the fixation belt 105, and the minutes particles which resulted from the abrading of the surface layer (tube) of the fixation belt 105, adhere to the peripheral surface of the abrasion roller 400. Adhesion of these residues to the peripheral surface of the abrasion roller 400 reduces the abrasion roller 400 in surface roughness, sometimes making it impossible for the abrasion roller 400 to be as effective to keep the fixation belt 105 stable in surface roughness as it is prior to the adhesion. More concretely, the studies made by the inventors of the present invention revealed that as the abrading operation is carried out, minute particles of foreign substances such as the paper dust having adhered to the fixation belt 105, minutes particles resulting from the abrading of the surface layer of the fixation belt 105, plug up the intervals among the abrasive particles on the peripheral surface of the abrasion roller 400, and therefore, the abrasion roller 400 reduces in surface roughness. It is likely that the surface roughness of the abrasion roller 400 reduces by an amount which is proportion to the increase in the length of time (which hereafter may be referred to as running time) the fixation belt 105 is abraded by the abrasion roller 400. In this embodiment, therefore, the peripheral surface of the abrasion roller 400 is cleaned by placing the cleaning roller 415 in contact with the abrasion roller 400.

Referring to FIGS. 11A and 11B, the peripheral surface of the cleaning roller 415 is covered with a pile 417, that is, a fabric with a surface of upright fine fiber. Therefore, as the cleaning roller 415 is placed in contact with the abrasion roller 400, the peripheral surface of the abrasion roller 400 is cleaned by the numerous fine strands of fiber. The cleaning roller 415 is always kept in contact with the peripheral surface of the abrasion roller 400 as shown in FIGS. 8A and 8B. To describe more concretely, the cleaning roller 415 is rotatably supported by its lengthwise ends, by a pair of cleaning arms 414 which are pivotally supported by the stationary shaft 142. Further, the cleaning arm 414 is provided with a spring 416, as a pressure generating means, one end of which is attached to the stationary shaft 142. Thus, the abrasion roller 400 always remains under a preset amount of pressure generated by the spring 416 in the direction to press the cleaning roller 415 toward the abrasion roller 400. In other words, the cleaning roller 415 is kept pressed toward the abrasion roller 400 by the spring 416.

Figure 13:
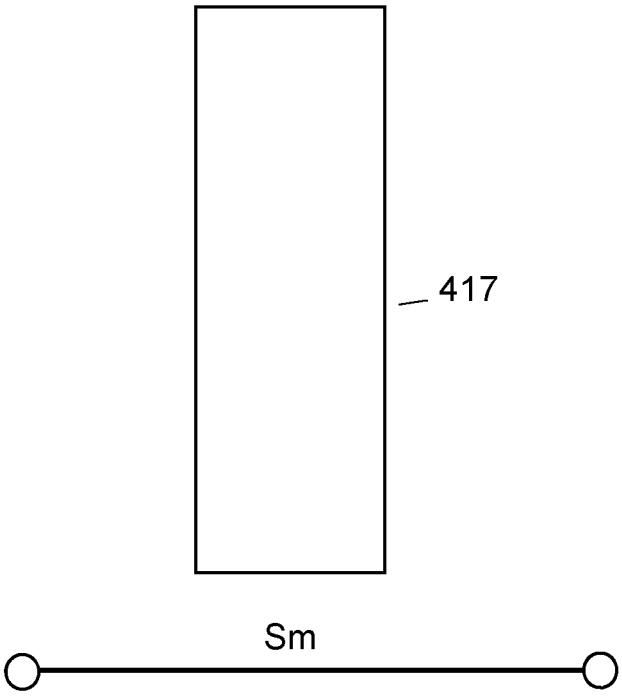
FIG. 13 is a schematic perspective view of a cleaning brush fiber of a cleaning roller and an average interval of a recess and protrusions on a surface of an abrasion roller of the fixing device.

Next, referring to FIGS. 11A, 11B, and 13, the structure of the cleaning roller 415 is described in detail. The cleaning roller 415 is a brush roller, which is roughly 10 mm in diameter. For example, it is made up of a metallic core 419 which is 6 mm in diameter, and a piece of pile (fabric created by densely planting numerous strands of fine fiber on substrative cloth) wrapped around the peripheral surface of the metallic core 419. In this embodiment, the strand interval of the pile 417 is no more than the average abrasive particle interval Sm, as shown in FIG. 13. The average abrasive particle interval of the peripheral surface of the abrasion roller 400 is 10-20 μm as described above. Therefore, the diameter of the numerous strands of fiber, of which the pile 417 is made, is made to be no more than 10-20 μm. However, if the pile 417 is excessively small in strand diameter, it is difficult for the pile 417 to remove the foreign substances on the peripheral surface of the abrasion roller 400. Therefore, the fiber strand diameter of the pile 417 is desired to be no less than ¼ of the average abrasive particle interval of the peripheral surface of the abrasion roller 400. For example, if the average abrasive particle interval Sm of the peripheral surface of the abrasion roller 400 is 10-20 μm, the fiber strand diameter of the pile 417 is desired to be no less than 5 μm.

More concretely, in this embodiment, as the material for the pile 417, polyamide fiber which is 2 d (denier, roughly 14 μm in diameter) in diameter is used. That is, numerous strands of filament of polyamide fiber are woven into a substrative cloth 418 of aramid fiber to create the material for the pile brush. Then material was cut into pieces with a preset width. Then, the cleaning roller 415 was formed by adhering a piece of the material to the peripheral surface of the metallic core 419 while wrapping the piece of material around the metallic core 419 to shape the piece of the material into a shape of a brush roller, to obtain the above described cleaning roller 415. As for the material for the fibrous filament as the material for the pile 417 of the cleaning roller 415, it may be filament of PPS (poly phenylene sulfide) or acrylic fiber, in addition to filament of polyamide fiber.

The cleaning roller 415 structured as described above is always kept in contact with the peripheral surface of the abrasion roller 400 to clean the peripheral surface of the abrasion roller 400. More concretely, since the cleaning roller 415 is kept in contact with the abrasion roller 400, it is rotated by the rotation of the abrasion roller 400 while cleaning the peripheral surface of the abrasion roller 400. However, the cleaning roller 415 may be directly driven by the same driving force source as the abrasion roller 400, or a driving force source different from the driving force source for the abrasion roller 400. In such a case, it is desired that a difference in peripheral velocity is provided between the cleaning roller 415 and abrasion roller 400. Further, the rotational direction of the cleaning roller 415 may be the same as, or opposite to, that of the abrasion roller 400.

In the case of this embodiment, the strand diameter of the pile 417 of the cleaning roller 415 is no more than the average abrasive particle interval of the peripheral surface of the abrasion roller 400. Therefore, it is possible to satisfactorily remove the minute particles of foreign substances having stuck in the recesses of the peripheral surface of the abrasion roller 400. That is, the cleaning roller 415 is made up of strands of fiber, the diameter of which is at least the same, or smaller than the maximum value of the Sm, is placed in contact with the abrasion roller 400. Therefore, it is possible to remove the minute particles of foreign substances having stuck in the intervals among abrasive particles, with the use of numerous strands of fiber of the pile 417 of the cleaning roller 415. Therefore, it is possible to continuously provide the peripheral surface of the abrasion roller 400 with such a level of roughness that it is necessary to keep the fixation belt 105 at a preset desired level in terms of surface roughness. Therefore, it is possible to substantially improve the abrading mechanism in the length of the service life of its abrasion roller 400.

Further, in a case where an abrading mechanism is structured so that the peripheral surface of its rotational abrading member is cleaned with a silicone rubber layer of its cleaning member, which has a smooth surface, as disclosed in Japanese Laid-open Patent Application 2008-40365, it is likely that the foreign substances removed from the rotational abrasive member are accumulated on the peripheral surface of the cleaning member, and therefore, the cleaning member is drastically reduced in its ability to continuously remove foreign substances as the foreign substances adhere to the rotational abrading member. That is, as the abrading operation is carried out a certain number times, the amount of the foreign substances having accumulated in the gaps among the abrasive particles becomes substantial, making it difficult for the rotational abrading member to be maintained at a desired level in terms of surface roughness. In comparison, in the case of the abrading mechanism in this embodiment, the cleaning roller 415, as the cleaning member, is a brush roller described above. Therefore, as the minute particles of foreign substances are removed from the abrasion roller 400, they are moved inward of the brush roller, being therefore unlikely to accumulate on the peripheral surface of the brush roller. Therefore, the cleaning roller 415 in this embodiment can maintain, for a long time, its ability to remove foreign substances from the peripheral surface of the abrasion roller 400 as the substances adhere to the abrasion roller 400. Therefore, it can keep the surface roughness of the abrasion roller 400 at a preset level for a long period of time.

EXPERIMENTS

Next, the experiments carried out to confirm the effectiveness of this embodiment are described. In these experiments, in which the abrading mechanism in this embodiment, which is structured as described above, and two comparative abrading mechanism which are different in structure from abrading mechanism in this embodiment were used, and the changes which occurred to the surface roughness of the abrasion roller 400 were measured along with the length of running time of the abrasion rollers 400. By the way, the running time of the abrasion roller 400 means the length of time the abrasion roller 400 abrades the surface of the fixation belt 105 by being placed in contact with the fixation belt 105.

In the case of the first example of a comparative abrading mechanism, a cleaning roller, the surface layer of which was a silicon rubber layer having a smooth surface, was employed. In the case of the second example of a comparative abrading mechanism, a brush roller made by covering the peripheral surface of a metallic core with a polyamide pile which was 6d (42 μm) in strand diameter) was used (PI brush (**6*d* in strand diameter)). In the case of the abrading mechanism in this embodiment, the brush roller made by uprightly planting fine strands of polyamide fiber, which were 2d (14 μm in diameter), on the peripheral surface of the metallic core was employed (PI brush (2*d* in strand diameter)). Further, as the abrasion roller 400, those structured as described above were employed. The abrasion roller 400 used in the experiments were roughly Ra 4.5 in initial surface roughness. The average interval (Sm) among the abrasive particles of the abrasion roller 400 was obtained by measuring abrasive particle distance across several sections of the peripheral surface of the abrasion roller 400**. It was roughly 10-20 μm.

FIG. 12 shows the results of the above described experiments. In FIG. 12, the vertical axis represents the surface roughness Ra of the abrasion roller 400, and the horizontal axis represents the running time of the abrasion roller 400. That is, FIG. 12 shows the changes which occurred to the surface roughness Ra of the abrasion roller 400 as the running time of the abrasion roller 400 increased. In the experiments, as the surface roughness of the abrasion roller 400 reduced to roughly Ra 2.0, it was determined that the abrasion roller 400 became ineffective in its ability to abrade.

As will be evident from FIG. 12, in the case of the first comparative abrading mechanism, the surface roughness of the abrasion roller 400 continuously reduced until the cumulative running time became roughly 30 minutes, at which it was Ra 2.0, and therefore, it could not display its abrading effect. In the case of the second example of a comparative abrading mechanism, the surface roughness of the abrasion roller 400 continuously reduced, becoming roughly Ra 2.0, and therefore failing to display its abrading effect, by the time when the cumulative running time became roughly 60 minutes. The examination of the peripheral surface of the abrasion roller 400 at this point in time revealed that minute particles of foreign substances became embedded in the recesses of the peripheral surface of the abrasion roller 400, and therefore, the abrasion roller 400 had reduced in surface roughness. In comparison, in the case of abrading mechanism in this embodiment, even after the cumulating running time of the abrasion roller 400 becomes roughly 180 minutes, the surface roughness of the abrasion roller 400 did not fall below Ra 2.0. The examination of the peripheral surface of the abrasion roller 400 confirmed that the minute particles of foreign substances, which had accumulated in the recess of the peripheral surface of the abrasion roller 400 were removed, and therefore, the surface roughness of the abrasion roller 400 remained at a level in a desirable range.

It became evident from the above described results that as long as the strand diameter of the pile of the cleaning roller 415 is less than the maximum value of the average interval (Sm) of the abrasive particles of the abrasion roller 400, it is possible to remove the minutes particles of foreign substances having stuck in the intervals among the abrasive particles of the abrasion roller 400.

MISCELLANIES

In the above-described embodiment, the abrasion roller 400 was made up of a metallic core (formed of stainless steel), and abrasive particles which were densely adhered to the peripheral surface of the metallic core with the use of a layer of adhesive. However, the embodiment is not intended to limit the present invention in scope. For example, the abrasion roller 400 may be such a roller that is made by blasting the peripheral surface of a cylindrical member to provide the member with a desired level of surface roughness. Further, the rotational abrasive member does not need to be an abrasive roller. That is, it may be in an other form than a roller. For example, it may be formed by adhering abrasive particles to a belt, that is, a rotational member other than a roller, to provide the belt with a desired level of surface roughness.

Further, in the above described embodiment, abrading mechanism was structured so that the cleaning roller 415 always remains in contact with the abrasion roller 400. However, the abrading mechanism may be structured so that the cleaning roller can be separated from the abrasion roller according to the operation of the image forming apparatus 1. For example, the abrading mechanism may be structured so that while the abrading operation is carried out by the abrasion roller, and the cleaning roller is rotated by the rotation of the abrasion roller, whereas while the abrasion roller is kept separated from the fixation belt, being therefore not driven, the cleaning roller is kept separated from the abrasion roller. On the contrary, the abrading mechanism may be structured so that while the abrasion roller remains separated from the fixation belt, the cleaning roller is placed in contact with the abrasion roller, whereas while abrasion roller is in contact with the fixation belt, the cleaning roller is kept separated from the abrasion roller. In such a case, the abrading mechanism is structured so that the cleaning roller can be independently driven from the other rollers, or it can be derivable even if the abrasion roller is not in contact with the fixation belt. Further, the abrading mechanism may be structured so that the cleaning roller can be placed in contact with the abrasion roller with a preset timing, or a command given by a user, to rotate the cleaning roller independently from the other rollers, or by the rotation of the abrasion roller.

While the invention has been described with reference to the structures disclosed herein, it is not confined to the details set forth, and this application is intended to cover such modifications or changes as may come within the purposes of the improvements or the scope of the following claims.

This application claims the benefit of Japanese Patent Application No. 2014-090094 filed on Apr. 24, 2014, which is hereby incorporated by reference herein in its entirety.

What is claimed is:

1. An image heating apparatus comprising:

a first rotatable member and a second rotatable member configured to form a nip therebetween for heating a toner image on a recording material;

a rubbing rotatable member configured to rub a surface of said first rotatable member, a peripheral surface of said rubbing rotatable member having a plurality of recesses and protrusions formed by a particulate abrasive; and a cleaning brush configured to clean a surface of said rubbing rotatable member, wherein an average interval Sm of the plurality of recesses and protrusions on the surface of said rubbing rotatable member is 10-20 μm, and said cleaning brush includes fibers each having a diameter of not less than 5 μm and not more than the average interval Sm.

2. An apparatus according to claim 1, wherein said rubbing rotatable member rubs the surface of said first rotatable member to provide a surface roughness Rz of 0.5-1.0 μm.

3. An apparatus according to claim 1, wherein said rubbing rotatable member has a surface roughness Ra of 2.0-4.0 μm.

4. An apparatus according to claim 3, wherein the particulate abrasive of said rubbing rotatable member provided on a surface thereof comprises #1000-4000 abrasive grain particles.

5. An apparatus according to claim 1, wherein the fibers are made of polyimide.

6. An apparatus according to claim 1, wherein said cleaning brush is capable of being driven by said rubbing rotatable member.

7. An apparatus according to claim 1, further comprising an urging member for urging said cleaning brush toward said rubbing rotatable member.

8. An apparatus according to claim 1, further comprising a spacing mechanism for spacing said rubbing rotatable member from said first rotatable member with completion of a rubbing operation.

9. An apparatus according to claim 1, wherein said rubbing rotatable member is a roller.

10. An image heating apparatus comprising:

a first rotatable member and a second rotatable member configured to form a nip therebetween for heating a toner image on a recording material;

a rubbing rotatable member configured to rub a surface of said first rotatable member, a peripheral surface of said rubbing rotatable member having a plurality of recesses and protrusions formed by a particulate abrasive; and a cleaning brush configured to clean a surface of said rubbing rotatable member, wherein an average interval Sm of the plurality of recesses and protrusions on the surface of said rubbing rotatable member is 10-20 μm, and said cleaning brush includes fibers each having a diameter of less than the average interval Sm and not less than ¼ of the average interval Sm.

11. An apparatus according to claim 10, wherein said rubbing rotatable member rubs the surface of said first rotatable member to provide a surface roughness Rz of 0.5-1.0 μm.

12. An apparatus according to claim 10, wherein said rubbing rotatable member has a surface roughness Ra of 2.0-4.0 μm.

13. An apparatus according to claim 12, wherein the particulate abrasive of said rubbing rotatable member provided on a surface thereof comprises #1000-4000 abrasive grain particles.

14. An apparatus according to claim 10, wherein the fibers are made of polyimide.

15. An apparatus according to claim 10, wherein said cleaning brush is capable of being driven by said rubbing rotatable member.

16. An apparatus according to claim 10, further comprising an urging member for urging said cleaning brush toward said rubbing rotatable member.

17. An apparatus according to claim 10, further comprising a spacing mechanism for spacing said rubbing rotatable member from said first rotatable member with completion of a rubbing operation.

18. An apparatus according to claim 10, wherein said rubbing rotatable member is a roller.

* * * * *